United States Patent [19]

Ketchum

[11] 3,990,425

[45] Nov. 9, 1976

[54] COMPOUND BOW

[75] Inventor: Frank W. Ketchum, Jacksonville, Tex.

[73] Assignee: AMF Incorporated, White Plains, N.Y.

[22] Filed: Apr. 7, 1975

[21] Appl. No.: 565,815

[52] U.S. Cl. ..... 124/23 R; 124/90

[51] Int. Cl.[2] ..... F41B 5/00

[58] Field of Search ..... 124/23 R, 24 R, 30 R, 124/30 A

[56] References Cited

UNITED STATES PATENTS

| | | | |
|---|---|---|---|
| 3,486,495 | 12/1969 | Allen | 124/24 R |
| 3,744,473 | 7/1973 | Nishioka | 124/24 R |
| 3,851,638 | 12/1974 | Alexander | 124/24 R |

*Primary Examiner*—Richard C. Pinkham
*Assistant Examiner*—William R. Browne
*Attorney, Agent, or Firm*—George W. Price; Walter Lewis

[57] ABSTRACT

In a compound bow the eccentric wheel assemblies at the limb ends are cross-coupled by the bow stringing so that they are constrained to move in unison so that the bow is self-tuning. Each wheel assembly has three grooved wheels rotatable on a common axis. A first one of the wheels is eccentric and has one end of the bowstring connected to it. The other end of the bowstring is connected to a similar eccentric first wheel at the other end of the bow. A first cross-coupling stretch is connected between a second wheel at one end of the bow and a third wheel at the other end. A second cross-coupling stretch is connected between a third wheel at the one end and a second wheel at the other end.

1 Claim, 3 Drawing Figures

FIG. 1
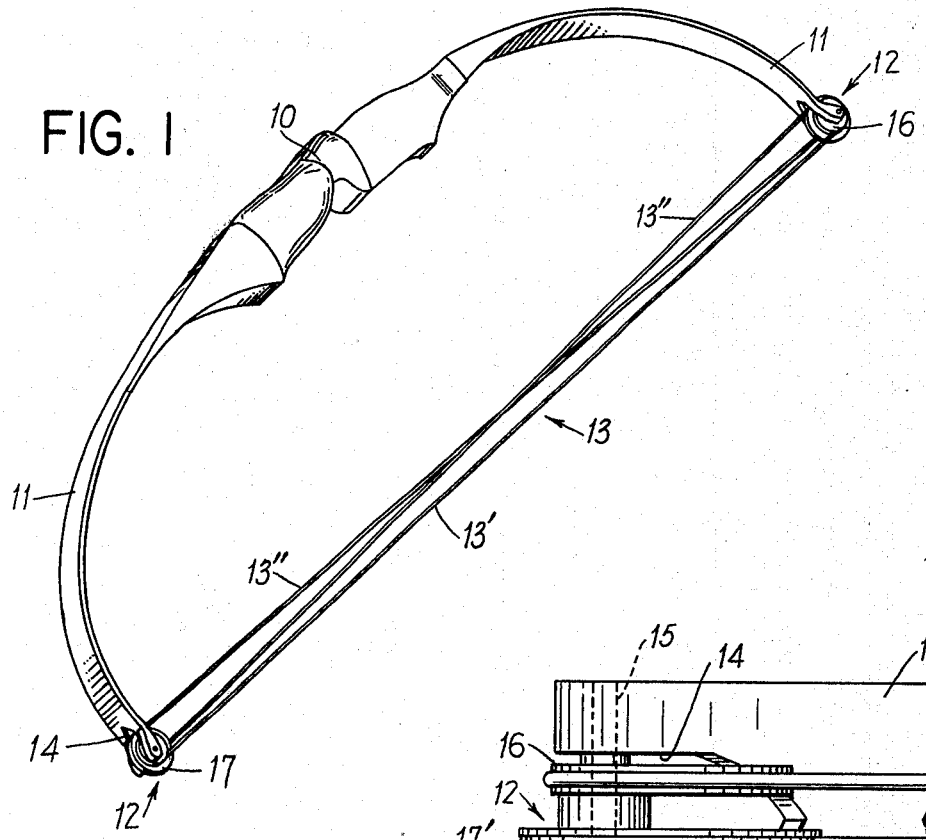
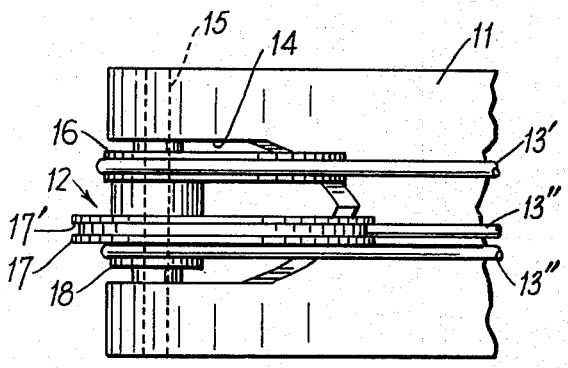
FIG. 3
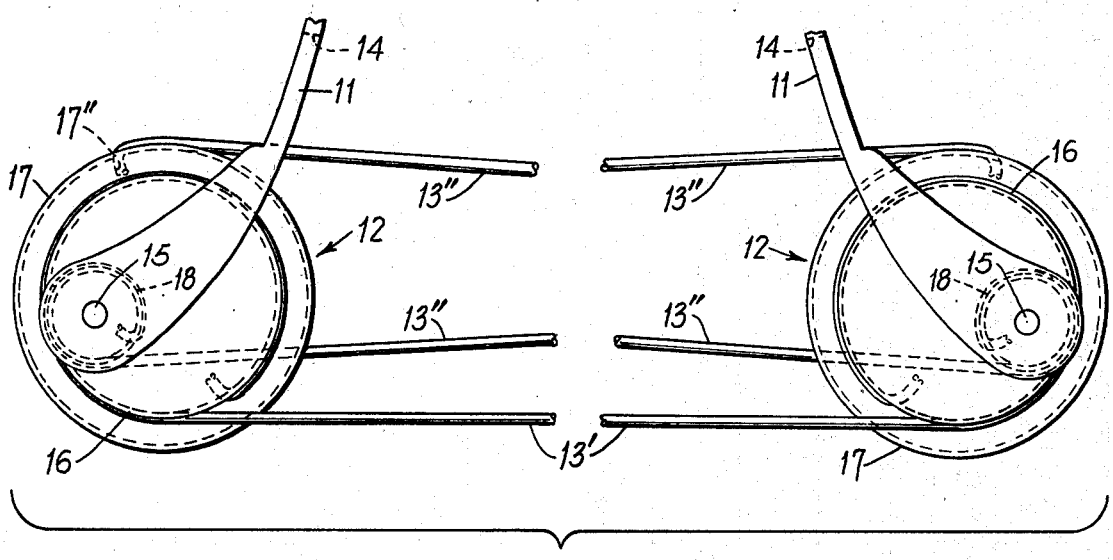
FIG. 2

COMPOUND BOW

This invention relates to an improvement in compound bows of the type shown in Allen U.S. Pat. No. 3,486,495 (1969) and in my copending patent application Ser. No. 553,140 for Improvement in Compound Bow filed on Feb. 26, 1975; and more particularly, to an automatic self-tuning feature therefor.

The invention will be more clearly understood by considering the following detailed description taken in connection with the accompanying sheet of drawing in which:

FIG. 1 is a perspective view of a compound bow having my invention;

FIG. 2 is an enlarged broken away side view showing the eccentric wheel assemblies and stringing of the bow; and FIG. 3 is an enlarged broken away plan view showing one of the eccentric wheel assemblies; the plan view being from the bottom of the left-hand end of FIGS. 1 and 2.

Referring now particularly to the drawing, the compound bow comprises a handle 10 having opposite resilient limbs 11, eccentric wheel assemblies 12 at the limb tips, and stringing 13 between the two eccentric wheel assemblies.

The limb tips have cutouts 14 which are spanned by a pin 15 for rotatably mounting the eccentric wheel assemblies. Each eccentric wheel assembly has three steps or wheels 16, 17, 18. These three parts 16–18 can be integral with each other or separable as taught in my said copending patent application for purposes of adjusting the draw length and/or weight of the bow.

The two eccentric wheel assemblies are alike. The two wheels 16 and 17 are rotatable on an eccentric axis, and the wheels 18 on a concentric axis. However, for purposes of obtaining a compound bow, the wheels 17 do not have to be eccentric, but can be concentric on the pins 15.

The stringing 13 comprises a central stretch 13′ extending between the wheels 16 and a pair of end stretches 13″. The end stretches 13″ extend from one wheel 17 and then across the bow to the opposite wheel 18. As will be obvious to those skilled in the art of compound bows, because of the eccentricity of the wheels 16 when the central stretch 13′ is pulled, there is a rapid buildup of energy in the bow before full draw is reached, and thereafter there is a fall off in the amount of force required to hold the bow at full draw.

In the invention, since the end stretches 13″ extend from each eccentric wheel 17 and across the bow to the opposite wheels 18, the eccentric wheel assemblies are cross-coupled so that they are constrained to move in unison. Thus, an automatic self-tuning feature is built into the bow. By contrast, in the prior art, the end stretches were not cross-coupled between wheel assemblies, but instead were anchored at their outer ends to the limbs or handle, and therefore, distinct means separate and apart from the wheel assemblies had to be provided at each end or side of the bow to tune it. By tuning a bow is meant, adjusting it so that when it is drawn, each half (top and bottom) is equal to the other and operates the same way.

In the drawings the central stretch 13′ and end stretches 13″ are shown as being discontinuous, but they operate as continuations of each other and in fact can be non-discontinuous provided means is provided to prevent the continuous string from slipping with respect to the wheels. In the illustrated embodiment of the invention, the stringing 13 comprises discontinuous sections 13′ and 13″ since this way it is somewhat easier to string the bow and provide against string slippage by anchoring the ends thereof to the wheels. As shown, all the wheels are provided with grooves, such as exemplary part 17′, see FIG. 3, to keep the string sections on their proper wheels; and the ends of the string sections are anchored to their proper wheels by being inserted into and fixed in holes in the wheels, such as exemplary part 17″, see FIG. 2.

I claim:

1. In a compound bow having a central handle, a pair of resilient limbs, an eccentric wheel assembly at the outer end of each of said limbs, and stringing for said bow extending between said wheel assemblies, said stringing comprising a central stretch and a pair of end stretches, each end stretch extending from one wheel assembly at one end of said bow to the other wheel assembly at the opposite end of said bow whereby said wheel assemblies are cross-coupled by said stringing to move in unison when said central stretch is pulled whereby said bow is automatically self-tuning; wherein each of said wheel assemblies comprise three grooved wheels for said stringing, said three wheels being mounted for rotation on a common axis, one of said three wheels having opposite ends of said central stretch connected thereto, said one of said three wheels being eccentric with respect to said common axis, another of said three wheels having one of the ends of said end stretches connected thereto, and the other ends of said end stretches being connected to the third of said three wheels at the other end of said bow and said third wheels being concentric with said axis whereby said wheel assemblies are constrained to move in unison upon draw of said central stretch.

* * * * *